US009109851B2

(12) United States Patent
Salva

(10) Patent No.: US 9,109,851 B2
(45) Date of Patent: Aug. 18, 2015

(54) PROCESS OF MANUFACTURING A RIFLE TO HAVE AN INTEGRAL SOUND SUPPRESSOR

(75) Inventor: Francisco Casas Salva, Sant Boi de Llobregat (ES)

(73) Assignee: GAMO OUTDOOR S.L., Barcelona (ES)

( * ) Notice: Subject to any disclaimer, the term of this patent is extended or adjusted under 35 U.S.C. 154(b) by 0 days.

(21) Appl. No.: 13/564,868

(22) Filed: Aug. 2, 2012

(65) Prior Publication Data

US 2013/0180149 A1 Jul. 18, 2013

Related U.S. Application Data

(63) Continuation-in-part of application No. 12/522,659, filed on Nov. 9, 2009, now Pat. No. 8,261,651, which is a continuation of application No. PCT/IB2007/054413, filed on Oct. 31, 2007.

(30) Foreign Application Priority Data

Jan. 12, 2007 (ES) ..... 200700101 U

(51) Int. Cl.

| | |
|---|---|
| ***F41A 21/00*** | (2006.01) |
| ***F41A 21/30*** | (2006.01) |
| ***F41A 21/02*** | (2006.01) |
| ***F41A 21/32*** | (2006.01) |

(52) U.S. Cl.

CPC ..... *F41A 21/30* (2013.01); *F41A 21/02* (2013.01); *F41A 21/325* (2013.01); *Y10T 29/49826* (2015.01)

(58) Field of Classification Search

CPC ..... F41A 21/30; F41A 21/325
USPC ..... 89/14.05, 14.2, 14.3, 14.4, 16; 42/76.01, 76.02; 181/223
See application file for complete search history.

(56) References Cited

U.S. PATENT DOCUMENTS

| | | | | | |
|---|---|---|---|---|---|
| 916,885 | A | * | 3/1909 | Maxim | 181/223 |
| 1,017,003 | A | * | 2/1912 | Kenney | 181/223 |
| 1,111,202 | A | * | 9/1914 | Westfall | 89/14.4 |
| 1,605,864 | A | | 11/1926 | Steinegger | |
| 2,448,382 | A | * | 8/1948 | Mason | 89/14.4 |
| 2,451,514 | A | | 10/1948 | Sieg | |

(Continued)

FOREIGN PATENT DOCUMENTS

| | | |
|---|---|---|
| AT | 153280 | 4/1938 |
| DE | 1 553 966 | 7/1971 |

(Continued)

OTHER PUBLICATIONS

Menier, Renan, International Preliminary Report on Patentability for International Application No. PCT/IB2007/054413 dated Apr. 23, 2009, 7 pages.

(Continued)

*Primary Examiner* — Gabriel Klein
(74) *Attorney, Agent, or Firm* — RatnerPrestia

(57) ABSTRACT

A process of manufacturing a rifle to have a sound suppressor on a barrel of the rifle. The process includes over-molding or over-injecting a structure onto the barrel so that the structure provides a sound suppressor, the barrel and sound suppressor form an integral assembly, and the sound suppressor defines an integral longitudinal extension of the barrel.

20 Claims, 4 Drawing Sheets

(56) References Cited

U.S. PATENT DOCUMENTS

| | | | | |
|---|---|---|---|---|
| 3,299,558 | A * | 1/1967 | Karl | 42/76.02 |
| 4,213,375 | A | 7/1980 | Pedler | |
| 4,584,924 | A * | 4/1986 | Taguchi | 89/14.4 |
| 4,769,938 | A * | 9/1988 | Chesnut et al. | 42/76.02 |
| 5,315,914 | A * | 5/1994 | Schumacher | 89/14.05 |
| 6,079,311 | A * | 6/2000 | O'Quinn et al. | 89/14.4 |
| 6,412,389 | B2 | 7/2002 | Fluhr | |
| 6,575,074 | B1 * | 6/2003 | Gaddini | 89/14.4 |
| 6,701,820 | B2 | 3/2004 | Fluhr | |
| 6,758,004 | B2 | 7/2004 | Huston | |
| 7,073,426 | B1 * | 7/2006 | White | 89/14.4 |
| 8,261,651 | B2 | 9/2012 | Casas Salva | |
| 8,881,862 | B1 | 11/2014 | Messer, Jr. et al. | |
| 2008/0251060 | A1 * | 10/2008 | Thurber | 124/83 |
| 2010/0126334 | A1 | 5/2010 | Shults et al. | |

FOREIGN PATENT DOCUMENTS

| | | | | |
|---|---|---|---|---|
| DE | 28 25 899 | | 3/1979 | |
| DE | 37 00 398 | | 7/1987 | |
| DE | 42 31 183 | | 3/1994 | |
| DE | 695 06 416 | | 6/1999 | |
| DE | 199 35 929 | | 2/2001 | |
| DE | 100 01 374 | | 6/2001 | |
| EP | 0 772 758 | | 5/1997 | |
| EP | 0 961 096 | | 12/1999 | |
| EP | 1 117 970 | | 7/2001 | |
| EP | 1 247 057 | | 10/2002 | |
| GB | 2104197 | A * | 3/1983 | F41B 11/00 |
| GB | 2 193 562 | | 2/1988 | |
| WO | WO 94/07103 | | 3/1994 | |
| WO | WO 96/03612 | | 2/1996 | |

OTHER PUBLICATIONS

Menier, Renan, Written Opinion for International Application No. PCT/IB2007/054413 dated Mar. 28, 2008, 5 pages.

Hafner, Dieter, Nullity Action (in German, 17 pages, with English translation, 15 pages) dated Oct. 8, 2012.

US Notice of Allowance for U.S. Appl. No. 14/259,809, dated Jul. 6, 2015, 13pp.

* cited by examiner

PROCESS OF MANUFACTURING A RIFLE TO HAVE AN INTEGRAL SOUND SUPPRESSOR

CROSS-REFERENCE TO RELATED APPLICATIONS

This is a division patent application of co-pending U.S. patent application Ser. No. 12/522,659, filed Nov. 9, 2009, which is a National Stage of International Application No. PCT/IB2007/054413, filed Oct. 31, 2007, which claims the benefit of Spanish Patent Application No. U 200700101, filed Jan. 12, 2007. The contents of these prior applications are incorporated herein by reference.

BACKGROUND OF THE INVENTION

The present invention generally relates to rifles and sound suppressors therefor. More particularly, this invention relates to a method of producing a rifle having a barrel, a bore within the barrel, and a structure comprising a sound suppressor, wherein the structure is over-molded or over-injected on the barrel so that the barrel and sound suppressor form a single part.

Various silencers and mechanisms to couple the silencer to the barrel of a carbine or pistol are known in the state of the art.

For example, European Patent No 1247057, of 2000, in the name of the company HECKLER & KOCH GMBH is known, which discloses a coupling device to secure a silencer on the barrel of a portable firearm that comprises a fastening for securing the silencer on the barrel of the portable firearm, where the silencer essentially has the form of a tube, with a coupling bracket fitted to the rear end of the silencer, and a barrel mouth that adjusts to the coupling bracket, on which the coupling bracket can be secured, and the barrel mouth presents a non-round configuration, where a supplementary part is installed on the coupling bracket on the side opposite the first and which can rotate with a contra-form complementary to the non-round configuration, so that the supplementary part can be secured to the barrel mouth only in one angular position. The silencer, together with the coupling bracket, is positioned so that it can rotate with respect to the supplementary part, and a blocking device is planed for inclusion, which will immobilize the silencer, together with the coupling bracket on the supplementary part, at a chosen angular position, without it being able to rotate.

The same company also owns European Patent No 1117970 of 2000, which discloses a coupling device for securing a silencer onto the barrel of a portable firearm including a fastening for securing the silencer onto the barrel of the portable firearm with a retention projection, which is positioned on the silencer, and which presents an orifice that centers a contra-projection, which is positioned on the barrel and which presents centered adjustment surfaces that adjust in the orifice, and a pin that can be dismounted for securing the retention projection on the contra-projection, so that the orifice and the adjustment surfaces are positioned centrally in a consecutive fashion in a seating zone, and with which at least one expansion space is provided between the two axial ends of the seating zone.

European Patent 0772758 dated 1995 is also known, in the name of Mr. Bernard Louvat, which discloses a silencer for a clay-pigeon or sports shotgun. It comprises a tubular body that adapts over the barrel(s) of the firearm and has a ring-shaped decompression chamber behind the tubular body, together with a series of internal transversal baffles held in place by separation parts, and includes orifices that allow the lead shot to pass through and wad evacuation. The silencer is adaptable to all calibers of clay-pigeon and sports shotguns and rifles, single or double-barrel, side-by-side or over/under, together with gauge 12 or 14 garden rifles.

U.S. Pat. No. 3,299,558 to Karl discloses a gun barrel covered with a layer of plastic to obtain a dent, scuff and scratch resistant gun construction. Karl describes the plastic layer as having noise-proofed characteristics, but is not adapted to suppress noise generated when a gun is fired. U.S. Pat. No. 1,017,003 to Kenney discloses a silencer that is mounted with threads or a detent feature located at or immediately adjacent the muzzle end of a gun barrel. The silencer does not encase any substantial portion of the gun barrel. Similarly, U.S. Pat. No. 2,448,382 to Mason discloses a silencer that is removably attached to the end of a gun barrel. Both Kenney and Mason require the front and rear sights of a gun to be centered each time their sound suppressors are installed on the gun barrel. U.S. Pat. No. 1,111,202 to Westfall discloses a silencer that is threaded onto a gun barrel and uses the annular space between the barrel and silencer casing as a gas chamber to help silence the report.

BRIEF DESCRIPTION OF THE INVENTION

This invention is a considerable advance in the air and fire rifle sector because it increases the performance of the firearm and reduces noise.

Economic advantages of the invention arise from a structure that is over-molded or over-injected on the barrel of a rifle and comprises a sound suppressor so that the barrel and the sound suppressor define a single integral assembly.

In view of the sound suppressor being part of a structure manufactured by over-molding or over-injection, the invention also offers significant economic advantages in terms of the production of barrels with sound suppressors, since barrels and their sound suppressors are usually two independent parts.

As discussed above, the prior art typically requires mechanisms to couple a sound suppressor to a rifle barrel. The coupling must provide stability (no movement) as well as firing reliability. In other words, it has to fit and, at the same time, remain calibrated with the front and rear sights centered. This is a problem, since centering is required each time the sound suppressor is coupled to the barrel. In contrast, centering of the sights is not necessary in the exemplary rifle disclosed herein, in that the front and rear sights are always centered because the front sight is fixed to the structure that provides the sound suppressor, and the structure is over-molded or over-injected onto the barrel.

The sound suppressor also has an improved noise insulating mechanism. Traditionally, a series of loose parts are employed in sound suppressors, which are then generally wrapped in cotton or similar materials. The exemplary rifle disclosed herein includes a sound suppressor comprising at least two parts that define an acoustic labyrinth, which is an evident saving from the economic point of view, since the acoustic labyrinth is very easy to install and manufacture. This feature also offers a significant technical improvement, because when the parts are coupled to the barrel with the over-molded/over-injected structure, they correctly center the exit pathway for the bullet or pellet.

An exemplary embodiment described herein provides a rifle comprising a barrel, a bore within the barrel, and a structure comprising a sound suppressor, wherein the structure is over-molded or over-injected on the barrel so that the barrel and the sound suppressor define a single, integral part.

BRIEF DESCRIPTION OF THE DRAWINGS

In order to facilitate the description, the present description is accompanied by four sheets of drawings that show an exemplary embodiment, which is cited as a non-limiting example of the scope of the present invention.

DETAILED DESCRIPTION OF THE INVENTION

Figure 1:
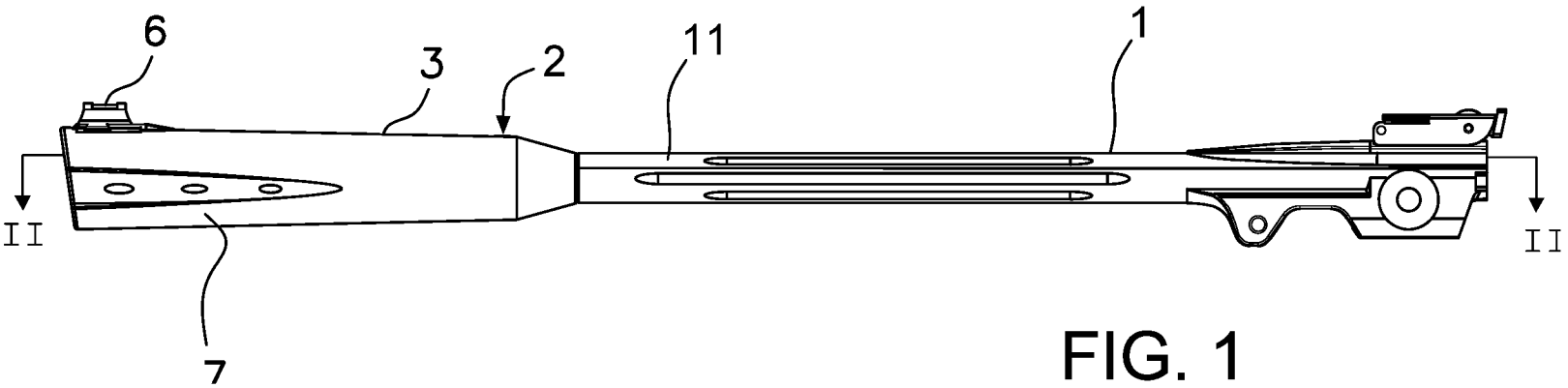
FIG. 1 is a side view of an air rifle according to the exemplary embodiment of this invention.
Figure 2:
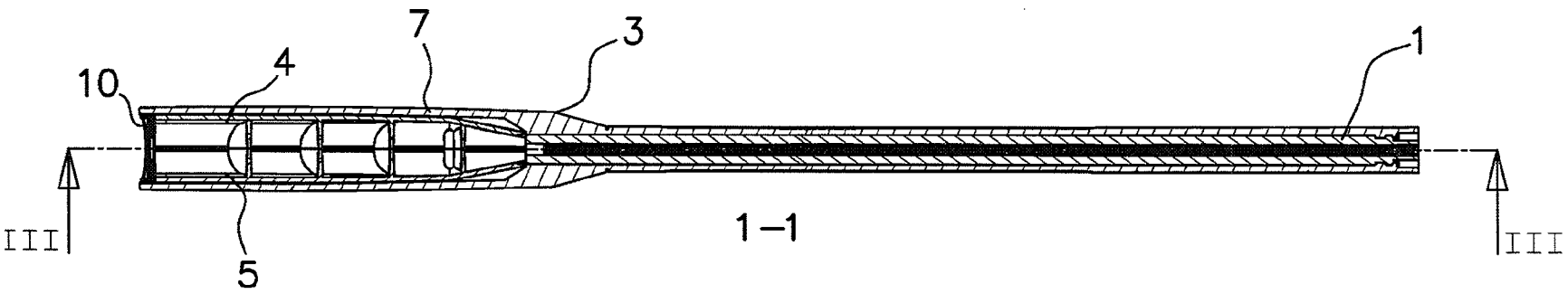
FIG. 2 is a cross-sectional view taken through line II-II of FIG. 1.
Figure 3:
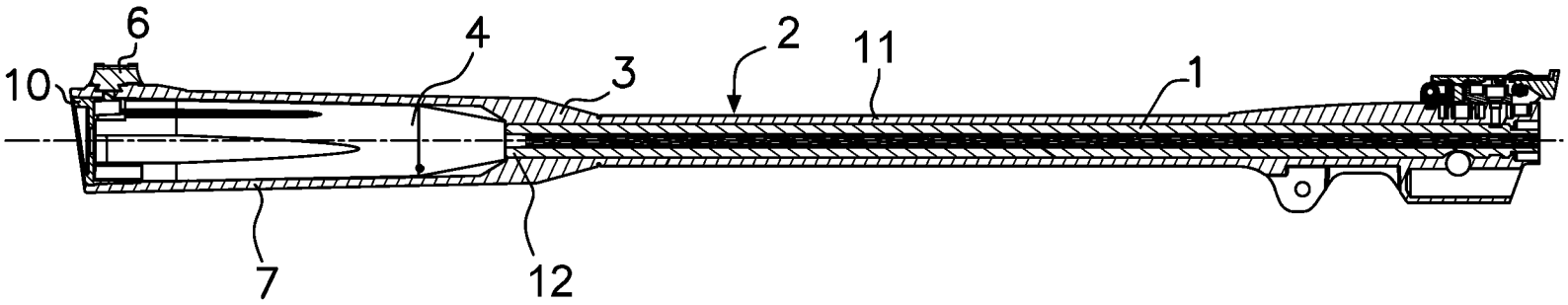
FIG. 3 is a cross-sectional view taken through line III-III of FIG. 2.

FIGS. 1, 2 and 3 illustrate an air rifle comprising a barrel 1 with a bore therein, and a structure 2 that has been over-molded or over-injected on the barrel 1 to provide a sound suppressor 3 coupled to the barrel 1. The over-molded/over-injected structure 2 defines a housing 7 that longitudinally and distally extends from a muzzle end 12 (FIGS. 2 and 3) of the barrel 1. A portion 11 of the over-molded/over-injected structure covers and encases a majority of the barrel 1. FIGS. 1 and 3 also illustrate a sight 6 mounted on the housing 7.

FIGS. 2 and 3 illustrate the housing 7 of the over-molded/over-injected structure 2 as encasing parts 4 and 5 of the sound suppressor 3, and a cover 10 closing a distal end of the housing 7.

Figure 4:
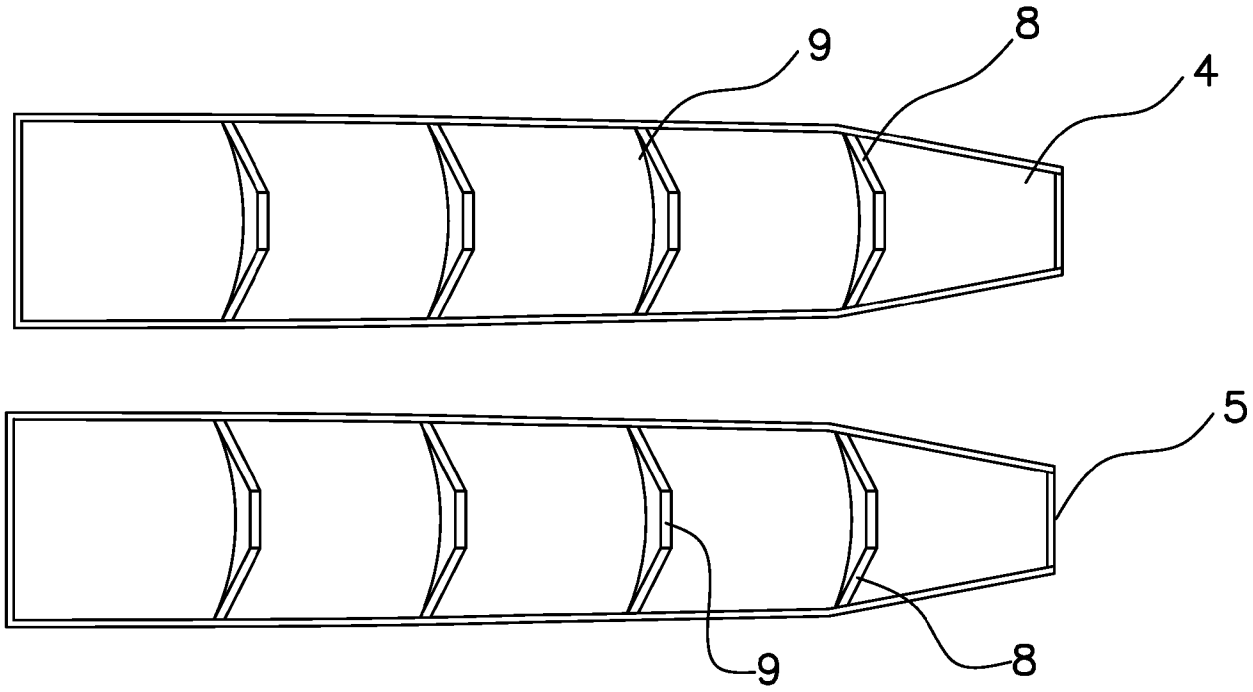
FIG. 4 illustrates two parts of the sound suppressor of the rifle of FIGS. 1 through 3.

Finally, FIG. 4 is an isolated view of the parts 4 and 5, and shows each of the parts 4 and 5 as comprising partitions 8 and neckings 9.

In the exemplary embodiment shown in FIGS. 1, 2 and 3, the structure 2, including the sound suppressor 3, housing 7 and portion 11, is over-molded or over-injected on the barrel 1 to form a single, integral part with the barrel 1.

As can be seen in the sections of FIGS. 2 and 3, the two parts 4 and 5 within the housing 7 define an insulating mechanism of the sound suppressor 3 by defining an acoustic labyrinth that ends with the cover 10 and provides damping of the firing noise.

Upon assembling the parts 4 and 5, the partitions 8 and the neckings 9 on the partitions 8 define a space or passage between the two parts 4 and 5 as an extension of the bore within the barrel 1.

In the exemplary embodiment, the sight 6 can be fixed onto the over-molded/over-injected structure 2, as illustrated in FIGS. 1 and 3.

This disclosure describes a rifle with a sound suppressor. The examples described here do not limit the present invention, which may have various applications and/or adaptations, all of which are within the scope of the following claims.

The invention claimed is:

1. A process of manufacturing a rifle barrel having a sound suppressor, the process comprising the step of:

forming a structure on the rifle barrel, including over-molding or over-injecting material over the rifle barrel so that the structure comprises a housing, the structure and the rifle barrel form an integral assembly, and the housing of the structure extends longitudinally and distally from a muzzle end of the rifle barrel;

inserting a sound suppressing element of the sound suppressor inside the housing of the structure such that the structure couples the sound suppressing element to the rifle barrel and the sound suppressing element is entirely housed inside and radially surrounded by the housing, wherein the sound suppressing element comprises an acoustic labyrinth formed by two mating components fitted together along a longitudinal plane coextensive with an axis of the rifle barrel, the two mating components having opposing mating faces that are coplanar with the longitudinal plane.

2. The process according to claim 1, further comprising inserting the sound suppressing element within the housing so that the sound suppressing element is disposed adjacent the a muzzle end of the rifle barrel.

3. The process according to claim 1, wherein the sound suppressing element defines a passage therein, and the inserting step causes the passage to be a longitudinal extension of a bore of the rifle barrel.

4. The process according to claim 1, the process further comprising providing the sound suppressing element to have partitions that at least partly define the acoustic labyrinth.

5. The process according to claim 1, further comprising the step of closing a distal end of the housing with a cover.

6. The process according to claim 1, further comprising the step of fixing a sight to the structure.

7. The process of claim 6, wherein the sight is a front sight.

8. The process of claim 1, wherein a portion of the structure is in direct contact with the rifle barrel.

9. The process according to claim 8, further comprising the step of fixing a sight to the structure.

10. The process of claim 8, wherein the portion of the structure in direct contact with the rifle barrel comprises material over-molded or over-injected onto to rifle barrel.

11. The process of claim 8, wherein the over-molded or over-injected material disposed over the rifle barrel and extending longitudinally and distally from the muzzle end of the rifle barrel comprises a single, continuous structure.

12. The process of claim 1, wherein a portion of the structure surrounds and is in direct contact with an outer surface of the barrel.

13. The process of claim 12, wherein the portion of the structure in direct contact with the rifle barrel comprises material over-molded or over-injected onto to rifle barrel.

14. The process of claim 1, wherein the step of forming the structure on the rifle barrel comprises over-molding or over-injecting the material onto the rifle barrel.

15. The process of claim 1, wherein the over-molded or over-injected material disposed over the rifle barrel and extending longitudinally and distally from the muzzle end of the rifle barrel comprises a single, continuous structure.

16. The process according to claim 15, further comprising the step of fixing a front sight to the structure.

17. The process according to claim 15, wherein the two mating components of the sound suppressing element define a longitudinal central passage therebetween and the inserting step disposes the passage as a longitudinal extension of the bore barrel.

18. The process according to claim 15, further comprising the step of fixing a sight to the structure.

19. The process of claim 15, wherein the step of forming the structure on the rifle barrel comprises over-molding or over-injecting the material onto the rifle barrel.

20. The process of claim 15 further comprising the step of closing a distal end of the housing with a cover.

* * * * *

UNITED STATES PATENT AND TRADEMARK OFFICE

CERTIFICATE OF CORRECTION

PATENT NO. : 9,109,851 B2
APPLICATION NO. : 13/564868
DATED : August 18, 2015
INVENTOR(S) : Francisco Casas Salva It is certified that error appears in the above-identified patent and that said Letters Patent is hereby corrected as shown below:

On the Title Page, ITEM [63], Related U.S. Application Data:

"Continuation-in-part of application No. 12/522,659, filed on Nov. 9, 2009, now Pat. No. 8,261,651, which is a continuation of application No. PCT/IB2007/054413, filed on Oct. 31, 2007."

should read:

--Division of application No. 12/522,659, filed on Nov. 9, 2009, now Pat. No. 8,261,651, which is a 371 of International Application No. PCT/IB2007/054413, filed on Oct. 31, 2007.--

Signed and Sealed this
Twenty-ninth Day of December, 2015

Michelle K. Lee

Michelle K. Lee
*Director of the United States Patent and Trademark Office*